US011661731B2

(12) United States Patent
Ferreira

(10) Patent No.: US 11,661,731 B2
(45) Date of Patent: May 30, 2023

(54) SPLASH OUT GUARD

(71) Applicant: Manuel A Ferreira, Cocoa, FL (US)

(72) Inventor: Manuel A Ferreira, Cocoa, FL (US)

( * ) Notice: Subject to any disclaimer, the term of this patent is extended or adjusted under 35 U.S.C. 154(b) by 0 days.

(21) Appl. No.: 17/665,376

(22) Filed: Feb. 4, 2022

(65) Prior Publication Data

US 2022/0290420 A1 Sep. 15, 2022

Related U.S. Application Data

(60) Provisional application No. 63/158,624, filed on Mar. 9, 2021.

(51) Int. Cl.
*E03D 9/00* (2006.01)

(52) U.S. Cl.
CPC ..... *E03D 9/00* (2013.01)

(58) Field of Classification Search
CPC ..... E03D 9/00; A47K 17/00; A47K 13/24
USPC ..... 4/300.3
See application file for complete search history.

(56) References Cited

U.S. PATENT DOCUMENTS

| | | | | |
|---|---|---|---|---|
| 6,119,282 | A * | 9/2000 | Serbin | A47K 13/24 4/300.3 |
| 7,921,478 | B1 * | 4/2011 | Vanini | E03D 9/00 4/300.3 |
| 10,337,182 | B1 * | 7/2019 | Bender | E03D 9/00 |
| 2015/0040303 | A1 * | 2/2015 | Uhm | E03D 9/00 4/300.3 |
| 2016/0340883 | A1 * | 11/2016 | Meyer | E03D 9/00 |

* cited by examiner

*Primary Examiner* — Christine J Skubinna

(57) ABSTRACT

An adjustable toilet guard is disclosed. This is a different concept and it helps keep bathrooms clean and families happy. It is flexible and can be adjusted based on the height preferences of the user. This is the first of its kind and there is nothing like it out there. It will also have glow in the dark borders in the handle grips and top edge of the guard to help facilitate the use of the invention at nighttime or low light situations.

3 Claims, 4 Drawing Sheets

SPLASH OUT GUARD

BACKGROUND OF THE INVENTION

Problem Solved: I realized that the toilet was a little too low for me. This would cause unwanted splashes and extra cleaning being needed to be done in the bathroom, which makes an inconvenience to an entire household. With this being a standard toilet height, I figured many others faced this same issue. This invention was created to help contain any splashes or extra messes, to benefit not only the user, but everyone in the household.

BRIEF SUMMARY OF THE INVENTION

The invention will be placed around the base of the toilet, which will fit to different shapes of toilets because of its flexible structure. It has a handle space on each side for easier up and down adjustment. Whenever the invention is needed to be used, the user simply slides it up to the height at which the guard is needed, up to 30 inches high. When it is done being used, it can be put back down easily where it will be out of the way of toilet access. It will sit underneath the toilet until it needs to be used again. The borders of the top edge of the guard and the handle grips will be glow in the dark for easier nighttime and low light use.

As stated, this invention will eliminate the splash of urine around the floor and the toilet area. This will also eliminate conflict within family members over smells and additional cleaning.

This adjustable guard gives boys and men of all heights the ability to solve this problem effectively. It can be placed at any height needed and can be completely put down for when it is not in use. Although this is an ongoing issue faced by many men daily, there is no other invention exactly targeting this issue anywhere. THE SPLASH OUT GUARD is the first of its kind and it tackles the issue efficiently. This is a new concept because of the way this invention helps keep urine splashes contained in the toilet area, where it should remain. This concept specifically is not available anywhere, especially with the adjustability aspect like this invention has. The invention is a parabola shape. This is used to make it more comfortable and accessible to use the toilet. The handle grips and top border of the invention will be glow in the dark to provide an easy view for low light and nighttime use.

The device is made of plastic and injection molded. The entire unit will be made in the same plastic.

DRAWING DESCRIPTION

Figure 1:
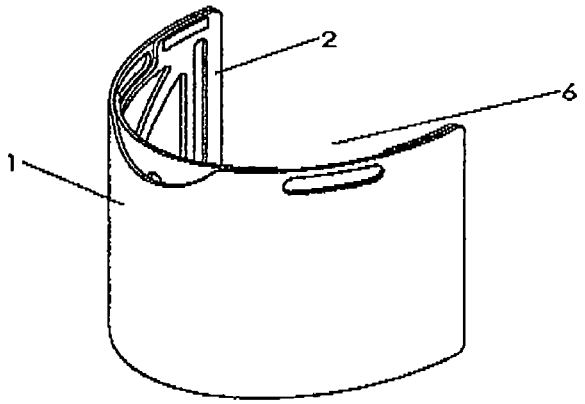

FIG. 1. The device as shown is in retracted or resting position. This is how it would look when it is not being used.

Figure 2:
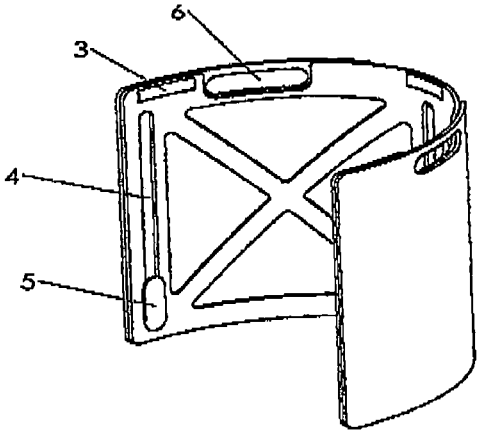

FIG. 2. The device as shown is in the same position as in FIG. 1, but is being shown from a rear angle.

Figure 3:
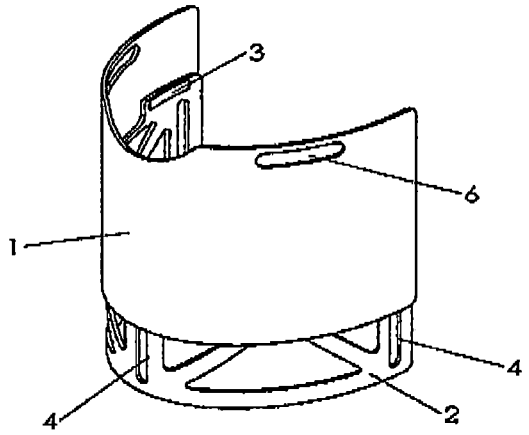

FIG. 3. The device as shown is in a slightly elevated position as it would be white being used on a lower height adjustment.

Figure 4:
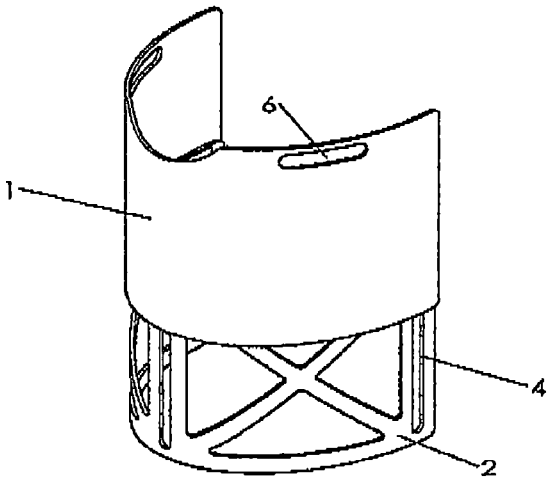

FIG. 4. The device as shown is a higher elevated position than in FIG. 3 and is at it would be while being used on a higher height adjustment.

Figure 5:
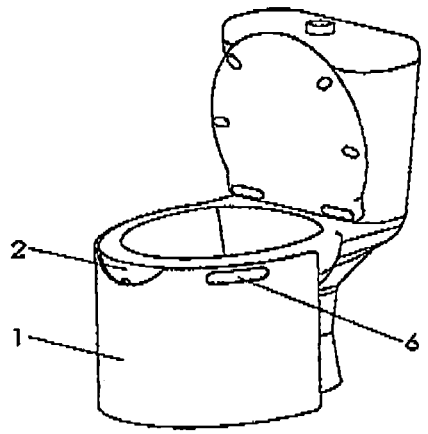

FIG. 5. The device as shown is in retracted or resting position while fitted onto a toilet as it would when it is not in use.

Figure 6:
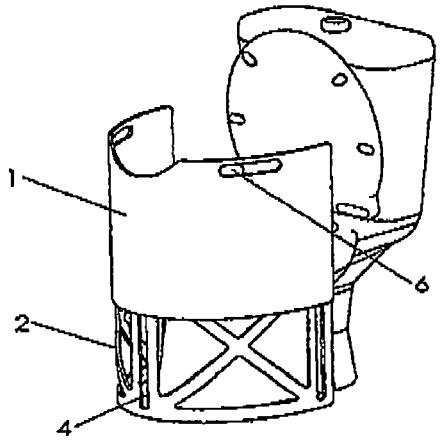

FIG. 6. The device as shown is in an elevated position while fitted onto a toilet as it would be used on an elevated height adjustment.

Figure 7:
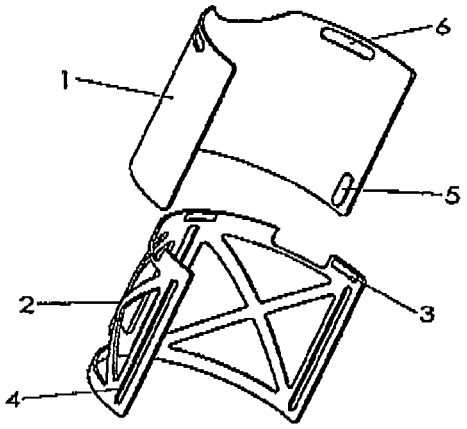

FIG. 7. The device is being shown in two separate pieces which the device is comprised of from a rear view.

Figure 8:
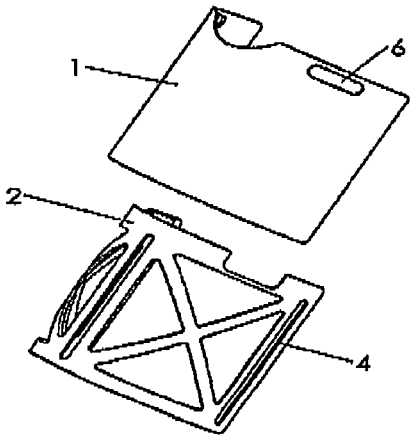

FIG. 8. The device is being shown in two separate pieces which the device is comprised of from a front view.

DETAILED DESCRIPTION OF THE INVENTION

FIGS. 1-8 show a toilet splash guard having a frame (2) and a guard (1). The guard having tabs (5) and the frame (2) having tracks (4) that receive the tabs (5) from the guard (1). The frame (2) and the guard (1) are parabolically shaped and configured to conform to the different shapes of toilet bases and bowls. Adhesive strips (3) are provided for attachment of the frame (2) to the toilet base. To use the device, a user lifts the guard (1) so that the tabs(5) slide in the tracks(4). The handles (6) may be used to lift the guard (1) from a non-use position, to a height of up to height 30 inches. The frame is flexible and the device is made of plastic.

The invention claimed is:

1. A toilet guard comprising: a frame and a guard, the frame having tracks to receive tabs from the guard connecting the guard to the frame; wherein the frame is shaped to conform around a base and a bowl portion of a toilet; wherein the tabs of the guard slide up and down in the tracks to elevate and reduce the guard in height; and the guard being slidable into place to capture any potential splash during standing urination.

2. The toilet guard of claim 1, wherein the guard is parabolic in.

3. The toilet guard of claim 1, wherein the frame has a flexible structure, allowing the frame to fit to different shapes of toilets.

* * * * *